US011292006B2

(12) United States Patent
Kuvaja et al.

(10) Patent No.: US 11,292,006 B2
(45) Date of Patent: Apr. 5, 2022

(54) ANTI-SPIN ARRANGEMENT

(71) Applicant: METSO OUTOTEC FINLAND OY, Tampere (FI)

(72) Inventors: Kari Kuvaja, Tampere (FI); Aki Lautala, Tampere (FI)

(73) Assignee: METSO OUTOTEC FINLAND OY, Tampere (FI)

( * ) Notice: Subject to any disclaimer, the term of this patent is extended or adjusted under 35 U.S.C. 154(b) by 571 days.

(21) Appl. No.: 16/105,509

(22) PCT Filed: Feb. 24, 2016

(86) PCT No.: PCT/FI2016/050116
§ 371 (c)(1),
(2) Date: Aug. 20, 2018

(87) PCT Pub. No.: WO2017/144765
PCT Pub. Date: Aug. 31, 2017

(65) Prior Publication Data

US 2019/0105657 A1 Apr. 11, 2019

(51) Int. Cl.
*B02C 2/06* (2006.01)

(52) U.S. Cl.
CPC ..... *B02C 2/06* (2013.01)

(58) Field of Classification Search
CPC ..... B02C 2/06
See application file for complete search history.

(56) References Cited

U.S. PATENT DOCUMENTS 501,843 A * 7/1893 McCully ..... B02C 2/06 241/209
525,410 A * 9/1894 Gates ..... B02C 2/06 241/209

(Continued)

FOREIGN PATENT DOCUMENTS

JP S52-072967 U 11/1950
JP S56-017945 U 7/1954

(Continued)

OTHER PUBLICATIONS

International Search Report and Written Opinion for International Patent Application No. PCT/FI2016/050116 dated Oct. 19, 2016.

(Continued)

*Primary Examiner* — Gregory D Swiatocha
(74) *Attorney, Agent, or Firm* — Andrus Intellectual Property Law, LLP

(57) ABSTRACT

An anti-spin arrangement for a gyratory crusher including at least one seal element configured to provide sealing of the top bearing of the gyratory crusher and at least one anti-spin element configured to reduce the spinning of the head of the crusher. The arrangement further includes a first adjustment element and a second adjustment element, wherein the at least one seal element and the at least one anti-spin element are configured to be individually adjusted with the first adjustment element and the second adjustment element respectively. A gyratory crusher, a mineral material processing plant and a method of adjusting an anti-spin arrangement of a gyratory crusher are also disclosed.

14 Claims, 5 Drawing Sheets

(56) References Cited

U.S. PATENT DOCUMENTS 535,716 A * 3/1895 McLanahan ..... B02C 2/06 241/209
1,150,864 A * 8/1915 Kent ..... B02C 2/06 241/211
1,553,333 A * 9/1925 Sholl ..... B02C 2/042 241/210
3,813,047 A * 5/1974 Torrence ..... B02C 2/06 241/211
4,037,800 A * 7/1977 Coxhill ..... B02C 2/06 241/213
4,491,279 A * 1/1985 Long ..... B02C 21/02 241/101.75
5,934,583 A * 8/1999 Jean ..... B02C 2/06 241/209
6,772,970 B2 * 8/2004 Davis ..... B02C 2/047 241/209
7,931,223 B2 * 4/2011 Lee ..... B02C 7/11 241/216
9,050,601 B2 * 6/2015 Ha ..... B02C 2/02
2009/0283616 A1 * 11/2009 Eriksson ..... B02C 2/047 241/25
2015/0273474 A1 * 10/2015 Eriksson ..... B02C 2/06 241/209
2016/0016175 A1 1/2016 Bergman et al.

FOREIGN PATENT DOCUMENTS

| | | | |
|---|---|---|---|
| JP | S56-076036 | U | 11/1954 |
| JP | S57-087851 | A | 6/1982 |
| JP | S57-201543 | A | 12/1982 |
| JP | S59-048743 | U | 3/1984 |
| JP | S62-201656 | A | 9/1987 |
| JP | 2004-136252 | A | 5/2004 |
| JP | 2014-108390 | A | 6/2014 |
| WO | 2012141560 | A1 | 10/2012 |
| WO | 2017115398 | A1 | 7/2017 |

OTHER PUBLICATIONS

Notice of Allowance for corresponding Japanese Patent Application No. 2018-544327 dated Jan. 12, 2020.

* cited by examiner

ANTI-SPIN ARRANGEMENT

CROSS-REFERENCE TO RELATED APPLICATIONS

This application is the U.S. national stage application of International Application PCT/FI2016/050116, filed Feb. 24, 2016, which international application was published on Aug. 31, 2017, as International Publication WO 2017/144765 A1 in the English language.

FIELD OF INVENTION

The invention generally relates to a gyratory crusher. In particular, but not exclusively, the invention relates to an anti-spin arrangement for a gyratory crusher.

BACKGROUND OF THE INVENTION

Mineral material, such as stone, is retrieved to be processed from the ground either by exploding or by digging. The mineral material may also comprise natural stone, gravel and construction waste. Both mobile and fixed plants are used for processing. The material to be processed is fed with e.g. an excavator or a wheel loader into a feed hopper of the processing plant, from where the material is forwarded to be processed.

In a gyratory crusher, undesired spinning of the crusher head is a commonly occurring problem in some situations, especially when the crusher is idling, i.e. there is no material in the crushing chamber between crushing shells. Accordingly, an anti spin element is used. Previously the seal of the top bearing of the crusher has functioned as an anti-spin element as well.

While the previous solution reduces spinning, the sealing of the top bearing has been less than optimal, since the required anti-spin characteristics have limited the material and adjustment of the seal. Furthermore, such an integrated anti-spin seal has been difficult to install.

The objective of the invention is to provide an anti-spin arrangement for a gyratory crusher that mitigates the problems of the prior art.

SUMMARY

According to a first aspect of the invention there is provided an anti-spin arrangement for a gyratory crusher, comprising

- at least one seal element configured to provide sealing of the top bearing of the gyratory crusher; and
- at least one anti-spin element configured to reduce the spinning of the head of the crusher from; wherein the arrangement comprises
- a first adjustment element and a second adjustment element, wherein the at least one seal element and the at least one anti-spin element are configured to be individually adjusted with the first adjustment element and the second adjustment element respectively.

The at least one seal element may comprise a first seal element and a second seal element.

The anti-spin arrangement may further comprise a wiper element.

The at least one anti-spin element may comprise two or more anti-spin elements.

The at least one seal element, the at least one anti-spin element and the first and second adjustment element may have a ringlike form.

The at least one anti-spin element may comprise perforations, grooves, ridges or folds.

The first and/or second adjusting element may have a substantially L-shaped cross-section.

The first and/or the second adjustment element may comprise a plurality of separate parts.

According to a second aspect of the invention there is provided a gyratory crusher comprising

- a top bearing;
- an upper frame; and
- a main shaft, wherein the crusher further comprises
- an anti-spin arrangement of the first aspect of the invention.

The gyratory crusher may further comprise a cover element detachably attached to the upper frame and configured to hold the anti-spin arrangement in place.

According to a third aspect of the invention there is provided a mineral material processing plant comprising a crusher according to the second aspect.

The mineral material processing plant may comprise a mobile plant.

According to a fourth aspect of the invention there is provided a method of adjusting an anti-spin arrangement of a gyratory crusher, comprising

- monitoring the functioning of at least one seal element configured to provide sealing of the top bearing of the gyratory crusher; and
- monitoring the functioning of at least one anti-spin element configured to reduce the spinning of the head of the crusher; wherein the method further comprises
- adjusting the at least one seal element and/or the at least one anti-spin element individually with a first adjustment element and a second adjustment element respectively.

The adjusting the at least one seal element and/or the at least one anti-spin element may comprise

- detaching a cover element;
- lowering the at least one seal element and/or the at least one anti-spin element from between an upper frame and a main shaft;
- replacing the at least one seal element and/or the at least one anti-spin element and/or a first adjustment element and a second adjustment element and/or adjusting with a first adjustment element and a second adjustment element respectively;
- rising the at least one seal element and/or the at least one anti-spin element in a position between an upper frame and a main shaft; and attaching the cover element.

Different embodiments of the present invention will be illustrated or have been illustrated only in connection with some aspects of the invention. A skilled person appreciates that any embodiment of an aspect of the invention may apply to the same aspect of the invention and other aspects

BRIEF DESCRIPTION OF THE DRAWINGS

The invention will now be described, by way of example, with reference to the accompanying drawings, in which.

DETAILED DESCRIPTION

In the following description, like numbers denote like elements. It should be appreciated that the illustrated figures are not entirely in scale, and that the figures mainly serve the purpose of illustrating embodiments of the invention.

Figure 1:
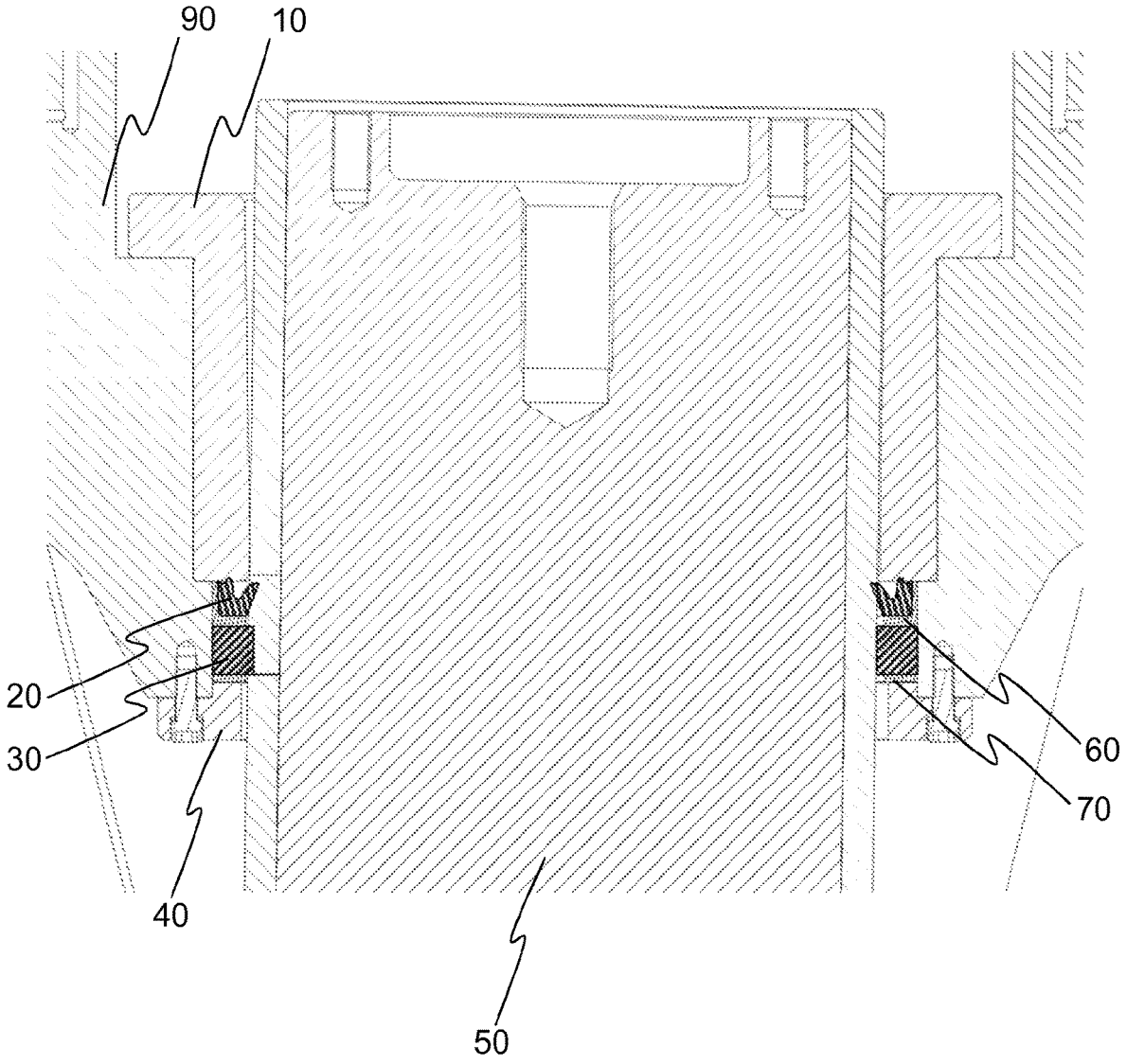
FIG. 1 shows a schematic cross-sectional view of an anti-spin arrangement of a gyratory crusher according to an embodiment of the invention.

FIG. 1 shows a schematic cross-sectional view of an anti-spin arrangement of a gyratory crusher according to an example embodiment of the invention. FIG. 1 shows the top bearing 10 on the main shaft 50 of the gyratory crusher. The anti-spin arrangement is installed below the top bearing 10, between the main shaft 50 and the upper frame 90. The anti spin arrangement comprises a first seal element 20 and a first anti-spin element 30. In an embodiment, the first anti-spin element is positioned below the first seal element 20. The first seal element 20 is configured to provide sealing of the top bearing 10 and the first anti-spin element 30 is configured to reduce the spinning of the crusher head. Further, the first seal element 20 is held at place and configured to be adjusted with a first adjustment element 60. Furthermore, the anti-spin element is in an embodiment held at place and configured to be adjusted with a second adjustment element 70.

FIG. 1 further shows a cover element 40 detachably attached to the upper frame 90 and configured to hold the anti-spin arrangement at place. The cover element 40 provides for easy access to the anti-spin arrangement and enables replacing the seal element 20 and/or the anti-spin element 30 without detaching the top bearing, i.e. the anti-spin arrangement is when being replaced first placed around the main shaft and then pushed in place with the help of the cover element 40. While the anti-spin arrangement is being assembled or replaced, the first anti-spin element 30 provides protection for the first seal element 20. The cover element 40 further provides for locking the first seal element 20 and the first anti-spin element in place, i.e. they only move relative to the main shaft 50.

The first seal element 20 and the first anti-spin element 30 comprise separate elements. In an embodiment, the first seal element 20 and the first anti-spin element 30 have a ringlike for. In an embodiment, the first seal element 20 and the first anti-spin element 30 comprise segments forming a ringlike whole. In an embodiment, the first seal element 20 comprises material such as rubber. In an embodiment, the first anti-spin element 30 comprises material such as rubber. In a further embodiment, the first anti-spin element 30 comprises elements such as perforations, grooves, ridges or folds configured to provide for more sensitive adjustment of the anti-spin effect of the first anti-spin element 30. In an embodiment, the first seal element 20 and the first anti-spin element comprise segments and form-locking means configured to lock the segments together so as to form for example a ringlike element.

The first adjustment element 60 and the second adjustment element 70 in an embodiment comprise ringlike elements. In a further embodiment, the first adjusting element 60 and the second adjusting element 70 have an L-shaped cross section in such a way that they reside both around and below or above the respective seal and/or anti-spin element. In a further embodiment, the first 60 and second 70 adjustment element have an L-shaped cross section in such a way that they reside around the respective seal and or anti spin element. Horizontal part of the L-shaped cross section is in an embodiment used to adjust sealing and/or anti-spin effect and vertical part of the L-shaped cross section is in an embodiment used in limiting the effect.

When the cover element 40 is tensioned in place e.g. by bolts against the upper frame 90, as illustrated for example in FIG. 1, the upward movement of the cover element 40 causes the seal element, the adjustment element(s) and anti-spin element to move towards the lower end of the top bearing 10. All parts made of elastic material are compressible in vertical dimension, which creates a compression force around the main shaft 50 that presses the seal element 20 and the anti-spin element 30 around the main shaft 50. Compression level is adjusted by choosing adjustment elements with suitable dimensions.

The first 60 and second 70 adjustment element in an embodiment comprise segments forming a ringlike whole or comprise separate elements positioned around the periphery of the respective seal and/or anti-spin element. In a further embodiment, the first 60 and/or second 70 adjusting element comprise a plurality of separate parts either around the periphery in a single layer or in several layers. The number and/or thickness and/or tightness of the first 60 and second 70 adjustment element in an embodiment is adjusted in order to adjust the sealing and/or anti-spin effect, i.e. the adjustment elements press the respective seal and/or anti-spin element against or around the main shaft 50. The first 60 and second 70 adjustment element in an embodiment comprise substantially rigid material such as metal. In an embodiment, the first seal element 60 and the second seal element 70 comprise segments and form-locking means configured to lock the segments together so as to form for example a ringlike element.

Figure 2:
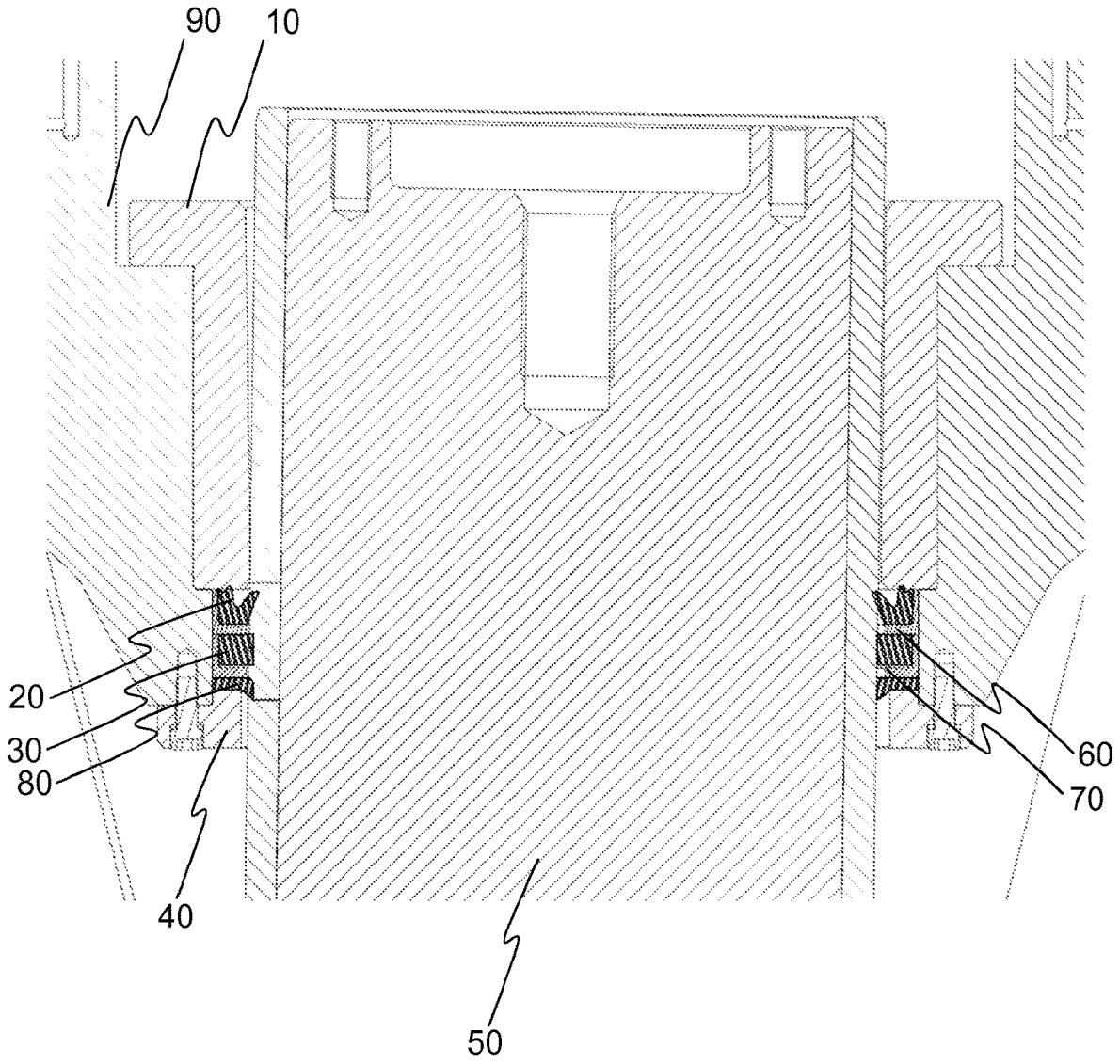
FIG. 2 shows a schematic cross-sectional view of an anti-spin arrangement of a gyratory crusher according to an embodiment of the invention.

FIG. 2 shows a schematic cross-sectional view of an anti-spin arrangement of a gyratory crusher according to an example embodiment of the invention. FIG. 2 shows the top bearing 10 on the main shaft 50 of the gyratory crusher. The anti-spin arrangement is installed below the top bearing 10, between the main shaft 50 and the upper frame 90. The anti spin arrangement comprises the first seal element 20 and the first anti-spin element 30. In an embodiment, the first anti-spin element is positioned below the first seal element 20. The first seal element 20 is configured to provide sealing of the top bearing 10 and the first anti-spin element 30 is configured to reduce the spinning of the crusher head. Further, the first seal element 20 is held at place and configured to be adjusted with the first adjustment element 60. Furthermore, the anti-spin element is in an embodiment held at place and configured to be adjusted with the second adjustment element 70. FIG. 2 further shows the cover element 40 detachably attached to the upper frame 90 and configured to hold the anti-spin arrangement at place.

Furthermore, FIG. 2 shows a first wiper element 80 configured to provide for sealing of the top bearing 10 and to clean the main shaft 50 in order to reduce the wear to the first seal element 20 and the first anti-spin element 30. In an embodiment, the first wiper element 80 is positioned below the first anti-spin element 30. In such an embodiment, the surface of the first anti-spin element abutting against the main shaft 50 in an embodiment comprises ridges or folds in a scale-like manner in order to increase the anti-spin effect.

Figure 3:
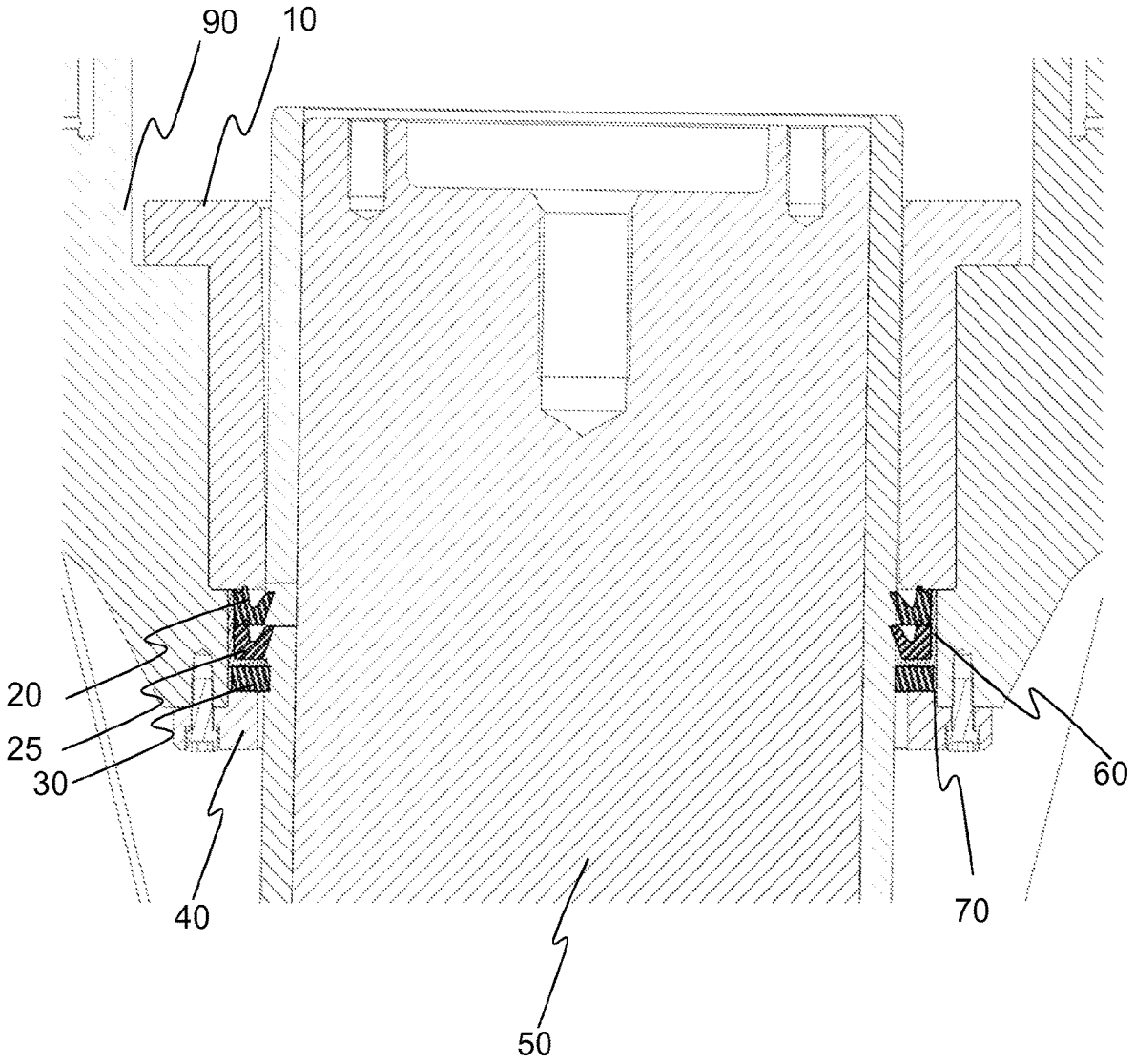
FIG. 3 shows a schematic cross-sectional view of an anti-spin arrangement of a gyratory crusher according to an embodiment of the invention.

FIG. 3 shows a schematic cross-sectional view of an anti-spin arrangement of a gyratory crusher according to an example embodiment of the invention. FIG. 3 shows the top bearing 10 on the main shaft 50 of the gyratory crusher. The anti-spin arrangement is installed below the top bearing 10, between the main shaft 50 and the upper frame 90. The anti spin arrangement comprises the first seal element 20 and the first anti-spin element 30. In an embodiment, the first anti-spin element is positioned below the first seal element 20. The first seal element 20 is configured to provide sealing of the top bearing 10 and the first anti-spin element 30 is configured to reduce the spinning of the crusher head. Further, the first seal element 20 is held at place and configured to be adjusted with the first adjustment element 60. Furthermore, the anti-spin element is in an embodiment held at place and configured to be adjusted with the second adjustment element 70. FIG. 3 further shows the cover element 40 detachably attached to the upper frame 90 and configured to hold the anti-spin arrangement at place.

Further, FIG. 3 shows a second seal element 25 positioned between the first seal element 20 and the anti-spin element 30. The second seal element 25 is configured to provide sealing of the top bearing 10. The second seal element 25 in an embodiment comprises an element similar to the first seal element 20. The second seal element 25 is held at place and configured to be adjusted with the first adjusting element 60 together with the first seal element 20 or in an embodiment with a further adjusting element (not shown).

Hereinbefore embodiments of the invention have been described with reference to FIGS. 1-3. Although the embodiments have been described as having one anti-spin element 30 and one or two seal elements 20,25, it is foreseen that the number of anti-spin elements and the corresponding adjusting elements in an embodiment is more than one, e.g. two or three. In an embodiment, the number of seal elements 20,25 and corresponding adjusting elements also is more than two, e.g. three or four. Furthermore, in an embodiment, several adjusting elements (not shown in FIGS. 1-3) are provided for each seal and/or anti-spin element in order to adjust them and to compensate for wear of the seal and/or anti-spin element or elements.

Figure 4:
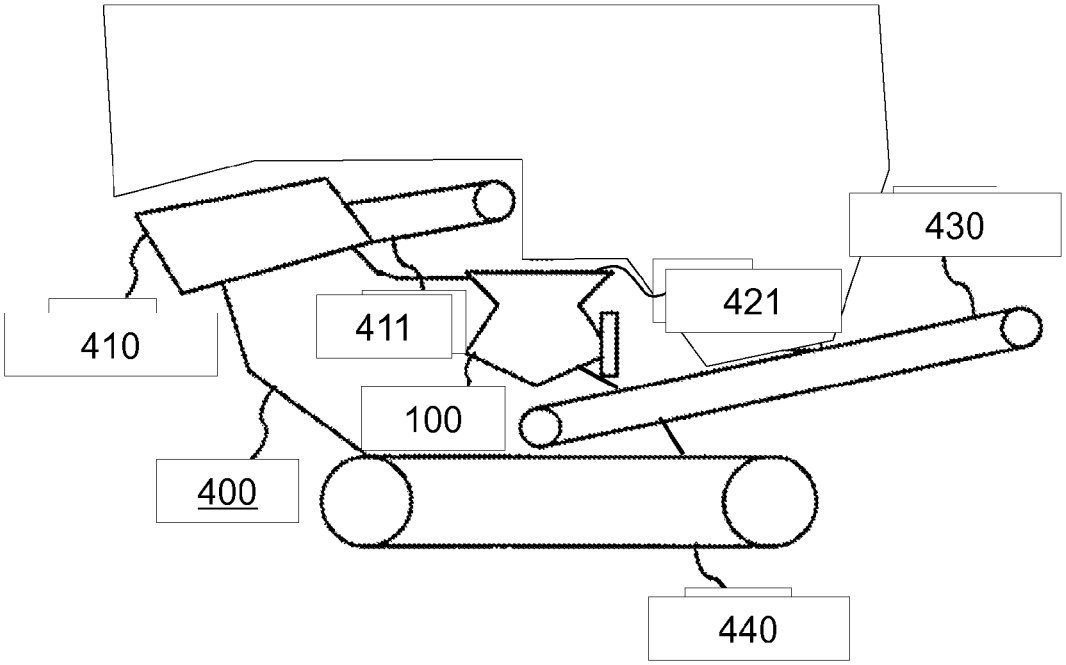
FIG. 4 shows a mineral material processing plant according to an embodiment of the invention.

FIG. 4 shows a mineral material processing plant 400 according to an embodiment. The mineral material processing plant 400 comprises a gyratory crusher 100 according to an embodiment of the invention comprising the anti-spin arrangement according to an embodiment of the invention. The crusher can be used as a primary crusher, or for example as an intermediate or secondary crusher, furthermore the crusher can be used in fine crushing. In an example embodiment, the mineral material processing plant 400 further comprises a feeder 410 and conveyors 411,430. The mineral material processing plant according to an example embodiment is a mobile mineral material processing plant and comprises a track base 440. Furthermore, a skilled person appreciates that the mineral material processing plant may comprise other parts and/or units not shown in FIG. 4, such as a motor and hydraulic circuits, and/or that some parts shown in FIG. 4 may not be present.

The material to be crushed is in an example embodiment fed to the feeder 410 and therefrom by the conveyor 411 to the crusher 100. The feeder 410 may also be a so-called scalper feeder. The material to be crushed coming from the conveyor is directed to the feed opening 421. In a further example embodiment, the material to be crushed is fed to the feed opening directly, for example by a loader.

The skilled person appreciates that the mineral material processing plant 400 can, in a further example embodiment, be a stationary mineral material processing plant comprising crushing, screening and conveying units. In a further example embodiment, the mobile processing plant may, instead of tracks depicted in FIG. 4, comprise wheels, legs, skids or other suitable support means.

Figure 5:
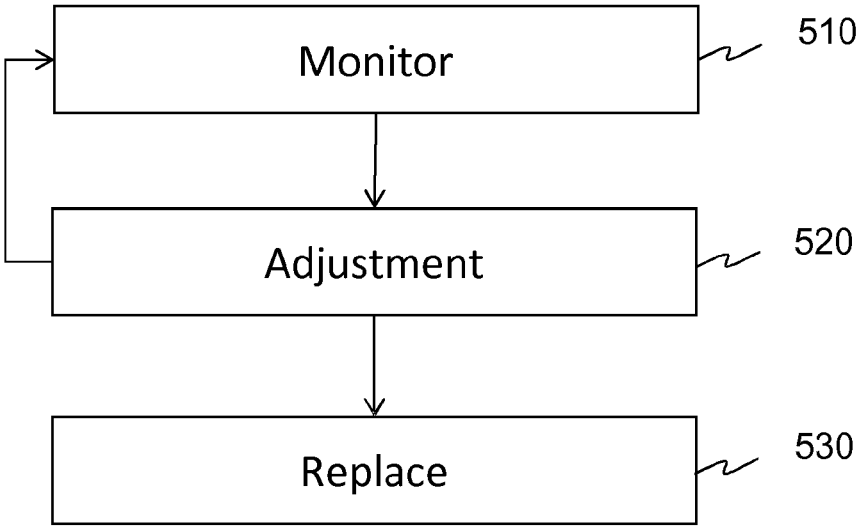
FIG. 5 shows a flow chart of an adjustment method according to an embodiment of the invention.

FIG. 5 shows a flow chart of an adjustment method according to an embodiment of the invention. At 510 the functioning of the anti-spin arrangement is monitored. For example wear of the first or second seal element 20,25 of the anti-spin element 30 or the wiper element 80 causes the functioning of the anti-spin arrangement to be compromised, i.e. the sealing starts to leak or spinning of the head is observed. At 520, the anti spin arrangement is adjusted. The adjustment is carried out using the adjustment elements, in an embodiment the first 60 and the second 70 adjustment element. The adjustment is carried out by tightening the adjustment elements to compensate e.g. for wear or by adding further adjustment elements for the same effect. After adjustment, the functioning of the anti-spin arrangement is monitored further. At 530, should the adjustment not prove effective, the anti-spin arrangement, or an element thereof is replaced with a new one.

In an embodiment, the adjusting is carried out by first detaching the cover element 40 and then lowering the at least one seal element 20,25 and/or the at least one anti-spin element 30 from between the upper frame and the main shaft, so that the can be accessed without dismantling the upper frame 90. Then the at least one seal element 20,25 and/or the at least one anti-spin element 30 and/or a first adjustment element 60 and a second adjustment element 70 is replaced should they require replacement and or the arrangement is adjusted by adjusting with the first adjustment element 60 and the second adjustment element 70 respectively. After the adjustment and/or replacement of parts has been carried out, the at least one seal element 20,25 and/or the at least one anti-spin element 30 are again raised in the position between an upper frame 90 and a main shaft 50 and the cover element 40 is attached.

Figure 6:
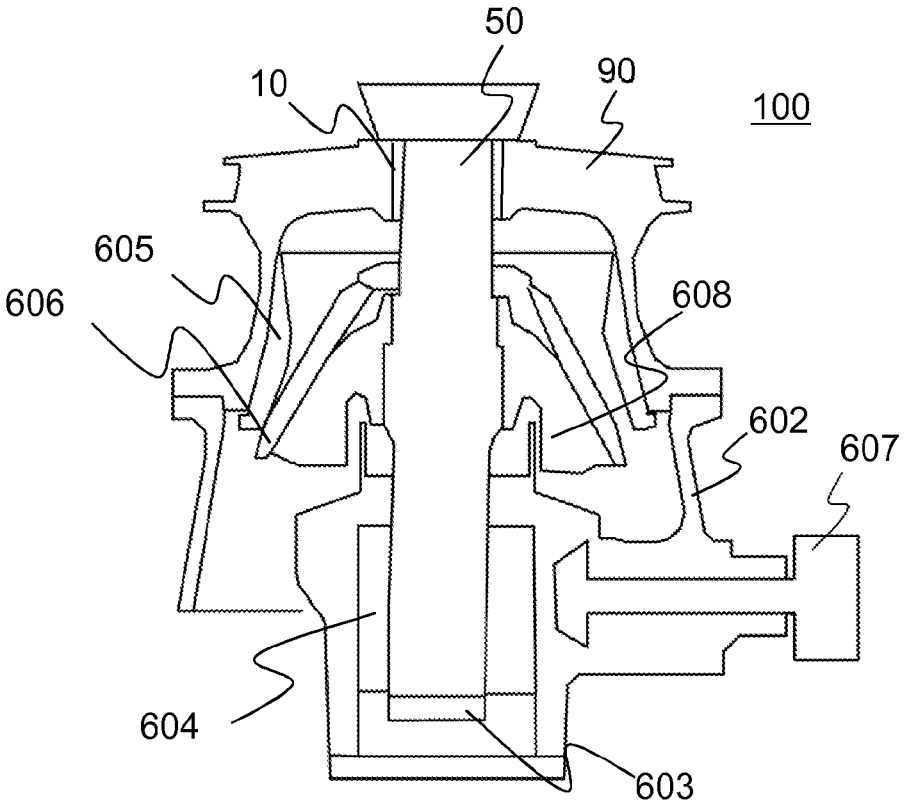
FIG. 6 shows a gyratory crusher according to an example embodiment of the invention.

FIG. 6 shows a gyratory crusher 100 according to an embodiment of the invention. The crusher comprises a frame, an upper frame 90 and a lower frame 602, a main shaft 50, a lubrication and adjusting piston 603, an eccentric assembly 604, an outer crushing part 605, an inner crushing part 606, a transmission 607 and a crusher head 608.

The transmission 607 is arranged to rotate the eccentric assembly 604 around the main shaft 50 producing gyratory movement between the inner 606 and the outer 605 crushing parts.

The top bearing 10 is preferably substantially cylinder shaped between the upper frame 90 and the main shaft, allowing the main shaft to move up and down in relation to the top bearing 10 when for example setting of the crusher is adjusted by the adjusting piston 603.

Without in any way limiting the scope of protection, interpretation or possible applications of the invention, a technical advantage of different embodiments of the invention may be considered to be an improved sealing and anti-spin effect. Further, a technical advantage of different embodiments of the invention may be considered to be individually adjustable sealing and anti-spin effect without compromising either. Still further, a technical advantage of different embodiments of the invention may be considered to be easier replacement and installation of the anti-spin and/or sealing. Still further, a technical advantage of different embodiments of the invention may be considered to be reduced wear of the sealing and anti-spin elements. Still further, a technical advantage of different embodiments of the invention may be considered to be replacement and/or adjustments of the elements of the sealing and anti-spin arrangement without dismantling the upper frame of the crusher.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. An anti-spin arrangement for a gyratory crusher including an upper frame, a top bearing, a main shaft and a head, comprising:

at least one seal element configured to provide sealing between the top bearing and the main shaft of the gyratory crusher;

at least one anti-spin element positioned below the at least one seal element and configured to reduce spinning of the head of the crusher;

a first adjustment element and a second adjustment element; and a cover element removably coupled to the upper frame to hold the at least one seal element and the at least one anti-spin element between the cover element and the top bearing, wherein the at least one seal element and the at least one anti-spin element are removable when the cover element is detached, wherein the at least one seal element and the at least one anti-spin element are configured to be individually adjusted with the first adjustment element and the second adjustment element respectively, by tightening the adjustment elements or by adding further adjustment elements; and the cover element is tensionable against the upper frame of the gyratory crusher to cause an upward movement of the at least one seal element, the adjustment elements, and the anti-spin element towards a lower end of the top bearing.

2. The anti-spin arrangement of claim 1, wherein the at least one seal element comprises a first seal element and a second seal element.

3. The anti-spin arrangement of claim 1, further comprising a wiper element.

4. The anti-spin arrangement of claim 1, wherein the at least one anti-spin element comprises two or more anti-spin elements.

5. The anti-spin arrangement of claim 1, wherein the at least one seal element, the at least one anti-spin element and the first and second adjustment element have a ring shaped form.

6. The anti-spin arrangement of claim 1, wherein the at least one anti-spin element comprises perforations, grooves, ridges or folds.

7. The anti-spin arrangement of claim 1, wherein the first and/or second adjusting element has a substantially L-shaped cross-section.

8. The anti-spin arrangement of claim 1, wherein the first and/or the second adjustment element comprise a plurality of separate parts.

9. A gyratory crusher comprising:

a top bearing;

an upper frame;

a main shaft; and an anti-spin arrangement comprising:

at least one seal element configured to provide sealing between the top bearing and the main shaft of the gyratory crusher;

at least one anti-spin element configured to reduce spinning of a head of the crusher; and a first adjustment element and a second adjustment element; and a cover element coupled to the upper frame and configured to hold the at least one seal element and the at least one anti-spin element between the cover element and the top bearing and to allow replacing the seal element and the anti-spin element when the cover element is detached; wherein the at least one seal element and the at least one anti-spin element are configured to be individually adjusted with the first adjustment element and the second adjustment element respectively, by tightening the adjustment elements or by adding further adjustment elements; and the cover element is tensionable against the upper frame of the gyratory crusher to cause an upward movement of the at least one seal element, the adjustment elements, and the at least one anti-spin element towards a lower end of the top bearing.

10. The gyratory crusher of claim 9, wherein the cover element is further configured to hold the anti-spin arrangement in place.

11. A mineral material processing plant comprising the crusher according to claim 9.

12. The mineral material processing plant according to claim 11, wherein the mineral material processing plant comprises a mobile plant.

13. A method of operating a gyratory crusher, comprising monitoring the functioning of at least one seal element configured to provide sealing of a top bearing of the gyratory crusher;

monitoring the functioning of at least one anti-spin element configured to reduce spinning of a head of the crusher; and allowing replacing the at least one seal element and the at least one anti-spin element by detachably attaching a cover element to an upper frame of the gyratory crusher;

adjusting the at least one seal element and/or the at least one anti-spin element individually with a first adjustment element and a second adjustment element respectively, by tightening the adjustment elements or by adding further adjustment elements; and tensioning the cover element against the upper frame so causing an upward movement of the at least one seal element, the adjustment elements, and the at least one anti-spin element towards a lower end of the top bearing.

14. The method according to claim 13, further comprising:

detaching the cover element;

lowering the at least one seal element and/or the at least one anti-spin element from between the upper frame and a main shaft;

replacing any one or more of: the at least one seal element; the at least one anti-spin element; the first adjustment element; and the second adjustment element;

raising the at least one seal element and/or the at least one anti-spin element to a position between the upper frame and the main shaft; and attaching the cover element.

* * * * *